US005399207A

United States Patent [19]

Kemp

[11] Patent Number: 5,399,207

[45] Date of Patent: Mar. 21, 1995

[54] PROCESS FOR SURFACE HARDENING OF REFRACTORY METAL WORKPIECES

[75] Inventor: Willard E. Kemp, Houston, Tex.

[73] Assignee: Fike Corporation, Blue Springs, Mo.

[21] Appl. No.: 158,504

[22] Filed: Nov. 29, 1993

Related U.S. Application Data

[63] Continuation of Ser. No. 763,339, Sep. 20, 1991, Pat. No. 5,316,594, which is a continuation-in-part of Ser. No. 467,050, Jan. 18, 1990, abandoned.

[51] Int. Cl.[6] ..... C23C 8/10

[52] U.S. Cl. ..... 148/209; 148/223; 148/238; 148/281

[58] Field of Search ..... 148/281, 209, 223, 238

[56] References Cited

U.S. PATENT DOCUMENTS

| | | | |
|---|---|---|---|
| 2,987,352 | 6/1961 | Watson . | |
| 3,053,704 | 9/1992 | Munday . | |
| 3,197,328 | 7/1965 | Jung et al. . | |
| 3,369,598 | 2/1968 | List . | |
| 3,401,923 | 9/1968 | Bearce . | |
| 3,408,236 | 10/1968 | Van Hartesveldt . | |
| 3,492,740 | 2/1970 | Geipel et al. . | |
| 3,615,885 | 10/1971 | Watson et al. . | |
| 3,630,501 | 12/1971 | Shabaker . | |
| 4,141,759 | 2/1979 | Pfistermeister et al. . | |
| 4,154,574 | 5/1979 | Keirle et al. | 432/58 |
| 4,193,758 | 3/1980 | Peterson et al. . | |
| 4,461,656 | 7/1984 | Ross | 148/209 |
| 4,474,553 | 10/1984 | Takahashi . | |
| 4,478,648 | 10/1984 | Zeilinger et al. . | |
| 4,547,228 | 10/1985 | Girrell et al. . | |
| 4,623,400 | 11/1986 | Japka et al. . | |
| 4,637,837 | 1/1987 | Von Matuschka et al. . | |
| 4,671,824 | 6/1987 | Haygarth . | |
| 4,756,774 | 7/1988 | Fox | 148/209 |
| 4,853,024 | 8/1989 | Song . | |
| 5,316,594 | 5/1994 | Kemp | 148/281 |

FOREIGN PATENT DOCUMENTS

| | | | |
|---|---|---|---|
| 555952 | 4/1958 | Canada . | |
| 0315975 | 1/1989 | European Pat. Off. | 148/630 |
| 56-146875 | 11/1981 | Japan . | |

OTHER PUBLICATIONS

Brochure of "Teledyne Wah Chang Albany" Summer 1990, Article by Willard E. Kemp Entitled Nobleizing: Creating Tough, Wear Resistant Surfaces on Zirconium, pp. 4, 5, & 8.

"Corrosion of Zirconium and Zircaloy-2", L. Anderson et al, Electrochemical Technology, vol. 4, No. 3-4, pp. 157-162, 1966.

Paper Entitled "Improved Wear Resistance Of Zirconium By Enhanced Oxide Films", By John C. Haygarth & Lloyd J. Fenwick Presented Apr. 9-13, 1984.

*Primary Examiner*—Sam Silverberg

*Attorney, Agent, or Firm*—Bush, Moseley, Riddle & Jackson

[57] ABSTRACT

A process and apparatus for forming a hardened outer shell (40) on a refractory metal workpiece (36) preferably heated in a fluidized bed of metallic oxide particles (38) in an environment of an inert gas and a reactive gas with the reactive gas either oxygen or nitrogen. The workpieces (36) are heated in the fluidized bed to a temperature between 800° F. and 1600° F. for a period of over two hours to form hardened outer shell (40) in two layers (42, 44). Outer layer (42) is an oxide or nitride layer having a thickness (T1) between 10 microns and 25 microns. Inner layer (44) is a case hardened layer of the refractory metal having a thickness (T2) between 25 microns and 75 microns. In one embodiment (FIG. 3 ) workpieces (56) may be cold worked by peening from finely divided metal oxide particles (54) to provide a uniform surface texture for subsequent hardening.

17 Claims, 2 Drawing Sheets

PROCESS FOR SURFACE HARDENING OF REFRACTORY METAL WORKPIECES

REFERENCE TO RELATED APPLICATIONS

This application is a continuation of application Ser. No. 07/763,339, filed Sep. 20, 1991, now U.S. Pat. No. 5,316,594 which is a continuation in part of application Ser. No. 467,050, filed Jan. 18, 1990, now abandoned.

BACKGROUND OF THE INVENTION

This invention relates to a process and apparatus for the surface hardening of workpieces made from refractory metals or metal alloys containing refractory metals and particularly such a process and apparatus for workpieces made from such refractory metal or alloys and utilized as bearings, valves, or similar products which are subjected to wear or abrasion.

A group of metals known as refractory metals consisting of zirconium, tantalum, titanium, hafnium, niobium and some others, have a common characteristic in that oxygen and nitrogen can penetrate and/or react with the surface of the metal to form a hardened case a few thousandths of an inch thick, and simultaneously build barrier compounds of oxides or nitrides on the surface, which prevent or limit further penetration. The characteristic is also observed with alloys of metals wherein at least the major metal portion is a refractory metal. The oxides and nitrides which form on the surface are extremely hard and wear resistant, but are very thin. The deeper or thicker cases which form beneath the surface are sometimes less hard, but have much greater depth, are less brittle, as they are made up of alloys of the base metal with oxygen or nitrogen rather than oxides or nitrides thereof. Oxides which form on the surface of these metals are known as ceramics and are very dense, hard and abrasion resistant. Nitrides which form are also separate compounds and are extremely hard and abrasion resistant. By appropriate combinations of temperature, atmospheres and other hardening techniques, it is possible to form combinations of hard surface compounds and alloyed sub surface cases which have very desirable properties.

Zirconium has long been recognized as a highly corrosion resistant material for severe applications. However, zirconium is relatively soft, about 65 Rockwell B, and is easily marred or damaged. It has not heretofore been suitable for heavy dynamic contact such as metal seals and wear parts. A number of previous studies indicated that zirconium could be case hardened by oxidizing the surface at temperatures about 1000° F. With careful control in a laboratory environment, a ceramic zirconium oxide surface nearly one (1) mil thick can be formed. Further, zirconium metal beneath the oxide surface can be hardened by alloying with oxygen.

However, there is a critical time and temperature relationship for hardening zirconium by oxidizing in order to obtain the desired hard and dense film. If heated for too long a period of time at a relatively high temperature, the zirconium alloy workpiece may be seriously damaged. Under isothermal heating, the rate of hardening as measured by oxygen pickup will decrease with time. During this period of decreasing rate of oxygen pickup, a dense, tough, tightly adhering, blue-black case will form without any effect on the surface finish, and without any significant distortion of the part. However, continued heating will result in a fairly sudden increase in oxidation rate, and a case which is less abrasion resistant, brittle, and rough-surfaced will form. In addition, significant dimensional changes may take place.

The borderline between the conditions which form desirable cases and those which are over-oxidized is critical, and the results of excess oxidation are severe, so production practice has been very conservative using relatively low temperatures and accepting cases much less than optimum. Such cases are suitable for most uses and do provide a degree of resistance against marring, but they are substantially less than theoretically possible, and are not suitable for heavy sliding contact or abrasive wear for prolonged periods of time.

As indicated, zirconium has superior corrosion resistance properties and is utilized extensively in the chemical processing industry particularly where high operating temperatures and/or pressures are involved in an aqueous media. However, zirconium has a relatively low resistance to abrasion and in order to increase its resistance to abrasion and resulting wear, it is necessary to harden the wear surfaces. Heretofore, such as shown in U.S. Pat. No. 4,671,824 dated Jun. 9, 1987, a process is disclosed for a hardened wear surface from providing a zirconium alloy surface by treating the zirconium alloy in a heated molten salt bath containing small amounts of sodium carbonate which is an oxygen bearing compound. The thickness of the blue-black coating formed by this process by oxidation of the zirconium alloy was not specified but was defined as a relatively thin coating.

A fluidizing bed for forming a hardened layer on a workpiece has been utilized heretofore for certain workpieces such as illustrated in U.S. Pat. Nos. 4,141,759; 4,547,228; and 4,923,400 for example. An inert gas and various metal treatment processes such as nitriding or oxidizing have also been utilized with a fluidized bed as shown in these references. However, the use of a fluidized bed for refractory metal workpieces, which naturally form barrier compounds to the infusion of reactive gases and particularly a fluidized bed of oxide materials having an affinity for the reactive gas, or metal oxide wherein the metal has an affinity for oxygen, at least as great as the refractory workpieces has not been shown by the prior art.

The hardening of reactive metals has been accomplished in a number of ways heretofore. However, such hardening operations have been characterized by the formation of a hard chemical compound of the workpiece metal and the reactive gas on the outer surface, without the benefit of deeper harder surfaces as the chemical reaction on the outer surface prevents or limits diffusion of the reactive ions for creating the deeper alloy case.

SUMMARY OF THE INVENTION

A preferred embodiment of the process of this invention for the surface hardening of workpieces made from refractory metals or metal alloys containing refractory metals utilizes fluidized bed heating with controlled gas mixtures to achieve a precise control of temperature, partial gas pressure, and time necessary to achieve desirable optimum hardened cases and hardened surface films for a workpiece without damage to the workpiece. Utilization of fluid bed techniques in combination with appropriate partial pressures for the reactive gas have allowed the reactive material to penetrate more deeply into the surface, forming a hard but ductile case, usually in combination with a hard chemical reactive surface layer.

A metal retort or container holds the workpiece in a bed of metallic oxide granules which desirably will consist primarily of oxides of the metal from which the workpiece is formed. The bed is rendered into a liquid-like state by the slow and uniform movement of gas through the bed or by mechanical agitation of the bed. Using as a bed material a metallic oxide of the same material as the workpiece eliminates most potential for diffusion of unwanted ions from the bed into the workpiece. The retort can be of any high temperature alloy but for best operation the alloy should not react with the gases. Copper nickel or nickel alloys are preferred if the reactive gas is nitrogen.

Control of gas velocity in a gas fluidized bed must be precise as average velocity is so low as to be undetectable by feel. In the desirable fluidization range, heat transfer is very much higher than an air furnace and uniformity of heating is assured under precise controls. Above the desirable rate of particle movement in the fluidized bed, the rate of heat transfer is significantly reduced. Below the desirable rate of particle movement, heat transfer is also very low. If agitation is absent, the bed will act as an insulator. It should be noted that in a fluidized bed, gas flow or agitation merely dislodges the oxide particles and gas or the type of gas does not effect heat transfer since the heat transfer function is independent of the gas. The heat transfer function is affected by the rate of particle movement and is greatest when the particles are in a true fluid-like state, whether that state is achieved through gas flow or mechanical agitation.

Advantages of utilizing a fluidized bed for heating of a workpiece to obtain a hardened outer case include the following: (1) heat transfer is more uniform than in an air furnace; (2) contamination is minimized as both the fluidized bed material and gas can be independently controlled; (3) the rate of heating and cooling can be controlled by cycling fluidization action on and off; (4) the furnace can be shut down and restarted without fear of thermal shock; (5) the workpiece can be exposed to a desired gas mixture for precise periods of time and temperature; and (6) the bed can be of materials which are inert to the workpiece so all the reactive elements are provided from the injected gases.

Fluidization of the bed can also be accomplished by mechanical means such as vibration or rolling of the bed. In some cases this is desirable in that it reduces the need for input gases as in some instances, the amount of gas needed for gas type fluidization far exceeds the amount of the inert carrier gas needed to transport the active or reactant gas.

One factor which is very important in the process of the invention, as particularly applied to nitriding operations, is in maintaining the level of nitrogen pressure at a predetermined relatively low amount. In some prior art devices, this is accomplished by using a vacuum furnace. In fluidized bed operations, it has been found useful to mix nitrogen with an inert carrier gas such as argon to maintain the desired nitrogen partial pressure. Other carrier gases can be used provided that they are inert under the conditions of the process. Preferred are members of Group VIII of the Periodic Table of Elements, e.g. helium, neon, argon, and Xenon, but particularly preferred is argon. The partial pressure of the nitrogen gas is in proportion to the molar proportion of the entire gas mixture. The bed material may be selected from any group of materials which have the desired shape and durability and which are non-reactive with the workpiece metal. In some cases the bed may have particles which will react with oxygen to a greater degree than the workpiece metal so as to remove oxide which may exist on the surface of the workpiece.

In some nitriding operations utilizing a fluidized bed, partial pressures are desired to be so low the gas mixtures have less than ½ to 1 percent by mole of nitrogen by molecular weigh in an inert carrier gas such as argon. In other nitriding operations, the amount of argon required to maintain an adequate gas fluidized bed is substantially greater than is necessary merely to transport or convey the reactive gas. The extra carrier gas, usually argon, is expensive and is a continuous source of contamination. One solution is to recirculate the gas after fluidizing. The recirculated gas can be cooled, analyzed and pumped back through the system. Another method is to fluidize with vibration or mechanical means so that the total amount of gas required to pass through the system is reduced.

Thus, as indicated above, the process of the present invention normally utilizes a fluidized bed of a metallic oxide in which a refractory metal alloy workpiece is positioned for application of the process for surface hardening of the workpiece. The outer surface hardened portion formed by the improved process when utilized with a zirconium alloy metal comprises two separate layers; an outer blue-black surface layer of an oxide coating or film of a thickness between around 10 microns (0.0004 inch) and 25 microns (0.001 inch), and an inner layer case hardened by alloying with oxygen and of a thickness between around 25 microns (0.001 inch) and 75 microns (0.003 inch). The inner case hardened layer is a transition layer between the outer layer and the zirconium metal and the hardness of the inner layer decreases progressively away from the outer layer.

A gas fluidized bed for providing such a hardened surface for a zirconium workpiece includes a container having a pulverulent bed preferably of finely divided zirconium oxide particles therein. A support immersed in the fluidized bed supports workpieces to be surface hardened. An oxygen or nitrogen containing gas is transmitted through the fluidized bed for fluidizing the zirconium oxide particles and the bed is heated to a predetermined high temperature of at least around 1200° F., and preferably around 1300° F. to 1400° F. for around three hours, for example. While zirconium oxide is preferred, other metal oxides may be used satisfactorily if they have an affinity for oxygen at least as great as zirconium, or the metal of which the workpiece is made. The preferred method is to use a bed which primarily consists of oxides of the refractory metal to be treated. For instance, titanium dioxide could be used as a bed to treat titanium. The temperature of the fluidized bed is maintained at a temperature generally between around 800° F. and 1600° F. depending on the particulate material and other factors.

It has been found to be desirable in one embodiment of the process of this invention to oxidize the outer surface of a workpiece with a small amount of oxygen in a carrier gas which allows a deeper penetration of oxygen into the base metal to provide a thicker case hardened layer. Argon is preferably utilized as the inert carrier gas and oxygen may comprise only around 1 to 3 percent by mole of the gas. By using only a very small percentage of oxygen a deeper inner case is obtained from diffusion of the oxygen into the workpiece.

Additionally, it has been found that oxidizing and nitriding operations are very susceptible to changes in the surface condition of the workpiece, and especially important is any mechanical working or stressing of the surface of the workpiece with might refine the grain structure. Smaller grain structures tend to form nitrided and oxidized outer cases more rapidly. One solution is to mechanically work the entire surface of the workpiece to provide a uniform grain structure. Cold working such as by peening or striking the outer surface of the workpiece with small diameter hard particles will greatly reduce the grain structure for a depth up to around 25 microns (0.001 inch) and also will provide a uniform surface texture or finish. Such striking may be accomplished, for example, with zirconium spheres or particles having a diameter of around 125 microns (0.005 inch) to 500 microns (0.020 inch).

Alternately, workpieces may be placed in a rotating basket with zirconium shot particles and tumbled within the basket. Working of the surface reduces the grain sizes in the zirconium workpieces by a factor of at least 3 and sometimes a reduction as high as 20 or 30 times is possible. In subsequent nitriding or oxidizing operations, the grain recrystallizes, and sometimes will then grow or increase to a size larger than the initial size prior to working. Under certain conditions, it may be desirable to nitride the outer surface of a zirconium workpiece prior to any oxidizing. An argon carrier gas may be introduced through the fluidizing bed to provide an initial surface hardening prior to introducing oxygen for oxidizing the zirconium workpieces.

The process for the surface hardening of a zirconium alloy workpiece immersed in a heated fluidized bed or a metallic oxide heated to a temperature over around 1200° F. has been found to be an effective and efficient method for obtaining the desired thickness and hardness for the hardened zirconium surface. Also, the method can be performed under precise controls for obtaining the precise thickness desired for the hardened surfaces.

In many heating applications, it is desired to place the workpiece in the fluidizing bed while at a relatively low temperature, and then increase the temperature of the bed and the workpiece simultaneously to minimize any distortion. It is also desirable for minimizing distortion to place the workpiece directly over the fluidized bed and heat it indirectly from the heat of the bed prior to inserting the workpiece into the bed. When performing either of these operations, it is desirable to fluidize the bed with a gas which does not contain oxygen or nitrogen and which is inert to the material, such as argon. In this event, no reaction occurs under conditions which can not be precisely monitored.

To control the process most accurately, it is desirable to fluidize entirely with an inert gas such as argon until the bed and the workpiece are stable at the desired temperature. Then fluidization can be conducted with an oxygen or nitrogen containing gas. During periods of heating or cooldown, fluidization can take place with argon. Thus, the hardening process can be precisely controlled and applied only when the workpieces are at the desired temperature.

Nitriding operations of titanium, for instance, are generally carried out at a temperature of 800° F. to 1500° F. The temperature is selected to be at least below that temperature at which phase changes or dramatic grain growth would take place. Nitriding and oxidizing temperatures for other alloys can be substantially different. For example, satisfactory oxidation of tantalum can take place at around 800° F.; oxidation of zirconium between 1100° F. and 1400° F.; nitriding of zirconium from 1300° F. to 1600° F.; and oxidizing of titanium from 800° F. to 1500° F. However, the process and apparatus for carrying out the process are generally similar except for such factors as the temperature, the time periods for heating and cooling, the precise gases utilized for fluidizing, and the type of metal particles used in the fluidizing bed.

An object of the present invention is to provide a process and apparatus for the surface hardening of workpieces made from refractory metal alloys in a heated fluidized bed of a metallic oxide pulverulent material similar to the metal forming the workpiece.

A further object of this invention is to provide such a method and apparatus for refractory metal workpieces for obtaining an outer surface hardened shell for the refractory metal workpiece comprising two contiguous layers composed of a relatively thin outer hardened surface layer of an oxide film, and a relatively thick inner case hardened layer of the refractory metal.

Another object is to provide a method for obtaining an outer case hardened shell for refractory metal workpieces in which a uniform surface grain structure is first provided for the workpieces by peening the surfaces with shot particles in a cold working step prior to the heating fluidizing step.

Another object is to provide a method for providing relatively deep nitride hardened cases in refractory metal workpieces while minimizing the formation of a surface layer of an oxidized structure.

Another object of this invention is to nitride or oxidize refractory metal workpieces in a fluidized bed using the minimum quantity of gases so as to minimize the entrance of contaminants into the system.

Other objects, features, and advantages of this invention will become more apparent after referring to the following specification and drawings.

DESCRIPTION OF THE INVENTION

Figure 1:
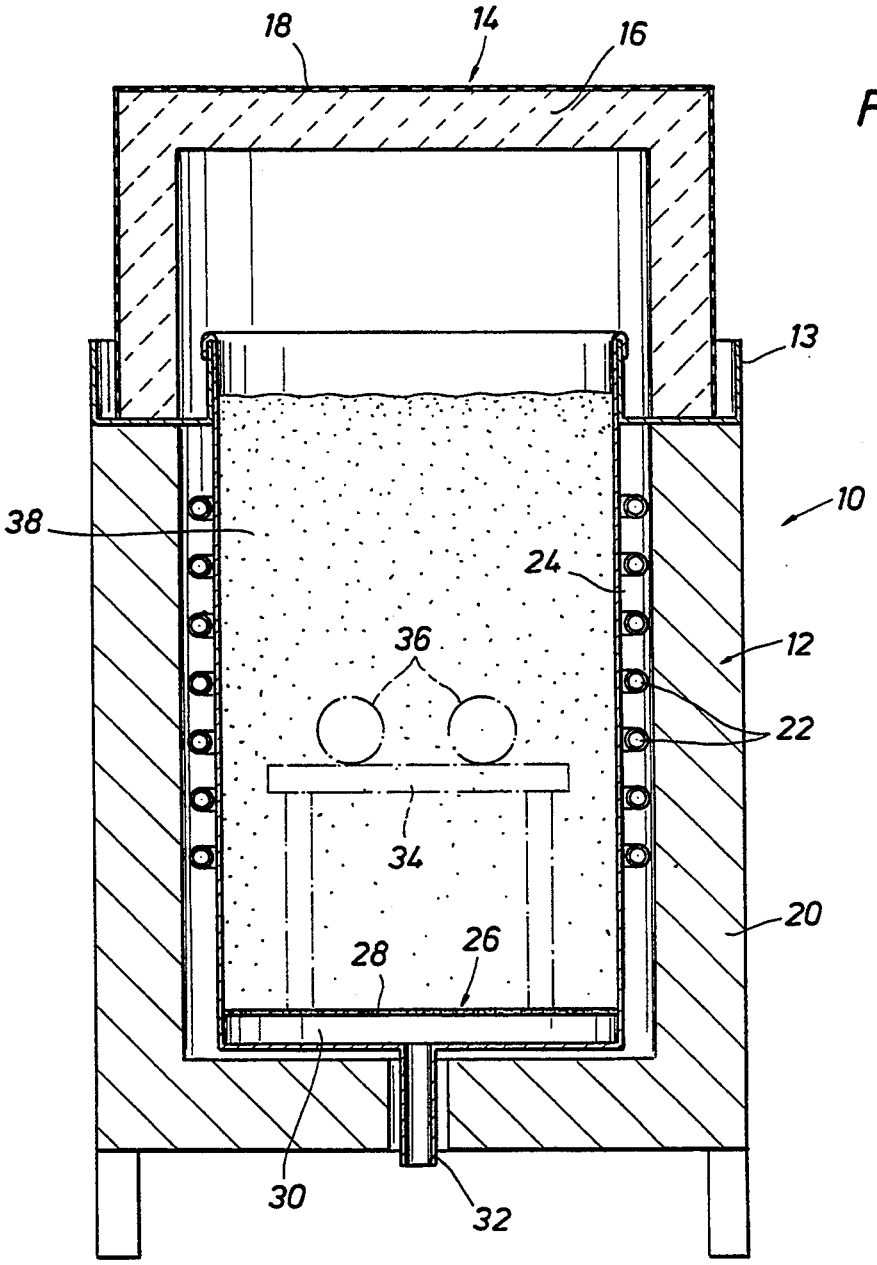
FIG. 1 is a sectional view of a radiant heating device for applying the process of this invention and containing the fluidized bed of finely divided zirconium oxide particles for the surface hardening of zirconium workpieces.

Referring now particularly to FIG. 1, an apparatus is illustrated for the improved process of this invention. A radiant heating device is generally indicated at 10 including a container generally indicated 12 having a channel shaped rim 13 defining an open upper end on which a removable cover generally indicated 14 is supported. Cover 14 includes a fluid permeable member 16 formed of a refractory material covered by an outer perforated metal liner 18.

Container 12 has a ceramic wall 20 with inner electrical resistant heating coils 22 thereon for heating of a relatively thin inner stainless steel liner 24. Gas supply means generally indicated at 26 are provided at the bottom of liner 24 and includes a gas permeable membrane 28 over a plenum chamber 30. A gas supply conduit 32 supplies gas or a gas mixture to plenum chamber 30 from a suitable source or supply of the desired gas or gas mixture i.e., either the gas as such or a material which will produce the desired gas under the conditions of the process. Suitable control valves for the gas sources are provided to control precisely the amount of a predetermined gas supplied through conduit 32. A support table 34 within container 20 is shown for the support of zirconium workpieces 36 such as ball valve members for easily heating the workpieces. A pulverulent metal oxide, such as finely divided zirconium oxide particles, is shown at 38 within container 20 and the upward flow of gas from plenum chamber 30 fluidizes the metal oxide sand 38 to provide a fluidized bed. A uniform predetermined temperature can be easily maintained by the fluidized bed and the length of the heating time can be precisely controlled.

In operation for applying the improved process of the present invention, pulverulent zirconium oxide shown at 38 is positioned within liner 24 and heated by the stainless steel liner 24 to a temperature of at least around 1200° F. and preferably between 1300° F. and 1400° F. Electrical energy is supplied to heat coils 22 from a suitable 220 volt electrical outlet for heating of liner 24. Reactive gas is supplied through conduit 32 from a suitable source or the like at a pressure of around two (2) psi gage, for example. Then, workpieces 36, such as bearings or movable valve members, are positioned on table 34 within inner liner 24. Cover 14 is positioned over container 12 fitting within the channel shaped rim 13 as shown in FIG. 1. Gas from plenum chamber 30 flows through permeable membrane 28, flows upwardly through the pulverulent zirconium oxide 38 for fluidizing the zirconium oxide, and then flows outwardly of container 20 through the gas permeable cover 14.

Heat is applied for around three hours in order to obtain the desired hardness but the exact time may vary depending on the workpiece and other factors, such a slight variations in alloy content. The desired thickness may be obtained by the prior calculation of a target weight by which the workpiece 36 will increase by the application of the process upon being oxidized by the fluidized bed of zirconium oxide. The target weight is established by placing a representative sample of the metal into the fluidized bed and heating it with the sample having a known weight and physical dimension. The weight is periodically removed and weighed to establish the precise time at which the heating and oxidizing of the fluidized bed should be terminated. During the removal time, the bed may be fluidized with an inert gas, such as argon, to prevent oxidation or may be unfluidized to prevent oxidation.

It has been found that if a zirconium workpiece 36 is heated for too long a period of time a relatively thick beige colored oxide film will form on the outer surface of the workpiece which is less resistant to abrasion than the blue-black oxide film of a lesser thickness. The thickness of the film may be estimated by a calculation of the increased weight of the workpiece resulting from the formation of the outer oxide film. A weight increase of three to four milligrams per square centimeter of surface area for the zirconium workpiece has been found to provide an optimum thickness of hardness for a zirconium alloy workpiece formed of "Zircadyne-702". It is believed for best results that a weight increase should not exceed around six milligrams per square centimeter of surface area. The time for heating workpiece 36 has been found to be between two and four hours depending on the particular zirconium alloy utilized for workpiece 36 and the temperature. After heating, workpieces 36 are cooled to ambient temperature preferably within container 12 and then removed. For cooling, an inert gas such as argon could be utilized for the fluidized bed or water can be poured into the bed.

A workpiece in any furnace undergoes a heating period followed by an isothermal period and then a cooldown period. The rates of heating and cooling will vary even among workpieces in the same furnace. This variation is not critical with most processes but when heating zirconium, the metal is oxidizing substantially all the time.

Figure 2:
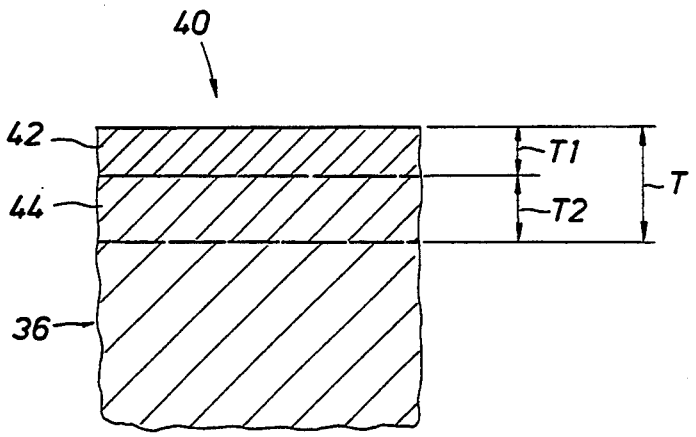
FIG. 2 is an enlarged section of the outer shell of a zirconium member after the surface hardening thereof by the fluidizing process in FIG. 1.

Referring to FIG. 2, the surface hardened outer shell or case of workpiece 36 is shown generally at 40 having a thickness T. Hardened shell 40 includes an outer surface layer 42 providing an oxide coating or film of a relatively small thickness T1 between around 10 microns (0.0004 inch) and 25 microns (0.001 inch), and an inner case hardened layer 44 of zirconium or a relatively large thickness T2 of between around 25 microns (0.001 inch) and 75 microns (0.003 inch). Thus, hardened layer 44 is a transition layer between outer layer 42 and the zirconium metal and its hardness decreases progressively from outer layer 42. A weight gain of around four milligrams per square centimeter after application of the process provides a blue-black color to the outer surface of the zirconium workpiece and this color is indicative of a generally optimum thickness. In the event the color becomes a beige color, this is an indication that the zirconium workpiece was exposed to oxidation for too long a period of time and results in a less hard outer surface which is undesirable as not having an abrasion resistance comparable to that of the zirconium workpiece having a hardened shell of a blue-black color. Thus, it is believed that an increase in weight resulting from the oxidizing of the outer surface of the zirconium workpiece should be less than around six milligrams per square centimeter of surface area and preferably around four milligrams per square centimeter. The above has been found to be optimum with a zirconium alloy designated as "Zircadyne-702 Alloy" and it is apparent that different zirconium alloys would obtain the desired thickness at different weight levels or at different heating times. When the workpiece is treated such as by peening to refine the surface grains, the resulting oxide layer may be gray in color instead of blue-black. The gray color has the same beneficial characteristics as the blue-black and in many cases is superior. When heated too long, the gray color will turn to beige indicating a loss of properties.

The hardness of workpieces immediately adjacent outer surface layer 42 utilizing the Vickers hardness scale has been around 1100 $Kg/mm^2$ (approx. 74 Rockwell C) with test results between around 950 and 1250 $Kg/mm^2$. The hardness of the hardened case layer 44 has been found to decrease from a maximum around 70 Rockwell C near layer 42 to the zirconium core metal hardness of the core material of the zirconium workpiece 36.

From the above, it is apparent that the present process for surface hardening of a zirconium alloy workpiece while immersed in a fluidized bed or a metallic oxide sand, such as zirconium oxide, provides an optimum environment for uniformly heating the workpiece at a precise temperature for a precise length of time to obtain the desired predetermined hardening of the shell of the zirconium workpiece, particularly as a result of periodic weighing of the workpiece so that the desired thickness can be calculated precisely. The zirconium workpieces 36 are cleaned in a bath of solvent prior to placing within the heating device so that precise oxidation is obtained on the surface of the workpieces without any foreign or deleterious particles being present.

It is understood that the sequence of steps involved in the process of the present invention, such as heating, preheating, fluidizing, and the placing and removal of the workpieces from the fluidizing apparatus, may be varied. For example, in one cycle, the bed is first preheated, then the workpieces are placed in the bed, next fluidizing with air is commenced, and the workpiece is thereafter removed from the bed. In another cycle, a bed is partially preheated, and fluidized. Then, the workpiece is placed in the fluidized material for additional heating during fluidizing and the workpiece is thereafter removed. In a third cycle, the bed is preheated and any fluidizing is stopped, then the workpiece is placed on the bed and fluidizing commenced so the workpiece sinks into the bed. Thereafter the fluidizing is stopped and the workpiece is removed. Thus, it is apparent that numerous variations in carrying out the process of this invention may be provided.

Figure 3:
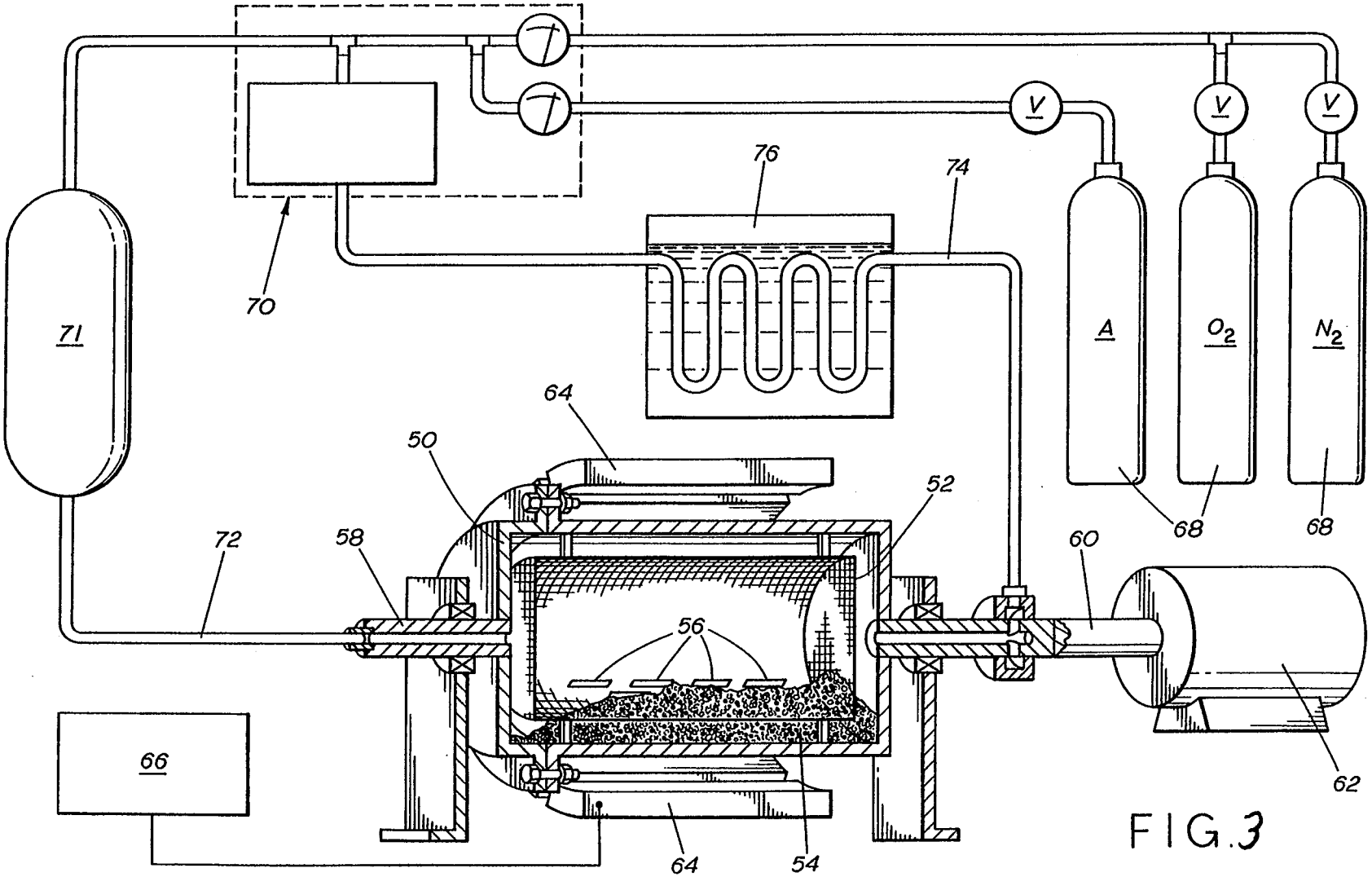
FIG. 3 is a schematic of an apparatus for peening the workpieces with metal shot particles and heating the workpieces in a fluidized bed.

Referring now particularly to FIG. 3, an apparatus and method is illustrated for peening, fluidizing, and nitriding or oxidizing refractory metal workpieces such as zirconium and titanium, for example. It has been found desirable to stress the outer surface of the workpieces prior to oxidizing or nitriding to reduce the grain size and to provide a uniform surface texture or finish. This may be accomplished by frictional or mechanical contact with the outer surface of the workpiece with hard shot particles, for example. A reduction in grain size to provide a uniform surface texture may also be accomplished by other means, such as rolling, polishing, or burnishing the workpieces. A smooth surface of around 4 to 30 RMS (root mean square) may be obtained by mechanical polishing of the outer surface of the workpiece. Electro polishing of the outer surface after mechanical polishing may provide an unusually smooth finish of around 4 to 8 RMS.

One desirable method is shown in FIG. 3 and utilizes small diameter zirconium shot particles rubbing against the refractory metal workpieces to provide the uniform surface texture desirable for obtaining a uniform case hardening. An outer cylinder 50 has a wire mesh basket 52 mounted therein and is filled to around 50 percent of its volume with zirconium shot particles of a diameter of around 125 microns (0.005 inch), for example and indicated at 54. The workpieces 56 are positioned within basket 52 in contact with the zirconium shot particles 54. Opposed shaft end portions 58 and 60 are secured to opposed ends of cylinder 50 and rotated by motor 62 thereby to tumble workpieces 56 in basket 52 at ambient temperature to provide a uniform surface texture. Workpieces 56 may be tumbled or rotated for two or three hours for example.

Electrical heating units shown at 64 are provided for heating of the workpieces 56 to a predetermined temperature prior to fluidizing. Under certain conditions it may be desirable to heat the workpieces 56 to a predetermined temperature during the tumbling operation. A suitable heater control 66 is utilized for obtaining the desired temperature.

Gas may be introduced within cylinder 50 during the tumbling or during heating. Argon, nitrogen and oxygen cylinders 68 are controlled by a gas control device at 70 to provide the desired percentage of nitrogen or oxygen in the inert carrier gas. The desired gas is supplied through expansion chamber 71, supply line 72, and hollow shaft portion 58 to cylinder 50. The gas exits through hollow shaft portion 60 and outlet line 74 to a cooling bath at 76 for return to control device 70 and supply line 72. Control device 70 includes a gas analyzer and flow meters to maintain the desired flow and percentages of predetermined desired gases to cylinder 50.

The peening or cold forming operation reduces grain size by a factor of at least 3 for a depth of at least 50 microns (0.002 inch) for example in zirconium and in some instances the grain size may be reduced of a factor of 25 to 30. Then, upon subsequent oxidizing during fluidization, the grain size increases to a size larger than the original size prior to the cold working operation. After cold working, the workpieces are heated to a temperature of at least 1200° F. and preferably around 1350° F. with the fluidizing argon carrier gas containing a small percentage, such as 1 to 3 percent of oxygen by mole. A hard outer layer of a gray color is obtained when the zirconium workpieces are first cold worked.

Following are specific non-limiting examples for the surface hardening of zirconium workpieces or samples. In a first example, a fluidized bed of zirconium oxide particulate material was preheated to 1400° F. utilizing air as a fluidizing bed. The fluidized bed was purged with pure argon for one-half hour and then zirconium sample pieces of a predetermined size were submerged within the fluidized bed. The gas mixture was then changed by adding four percent oxygen by mole to the argon gas and the fluidized bed and zirconium samples were heated for three hours at the temperature of 1400° F. After heating for three hours, the zirconium samples were removed from the fluidized bed and air cooled. The outer surface of the zirconium samples had a blue black color and a weight gain of approximately 3 mg per $cm^2$ was obtained by the samples. A hardness of the oxidized zirconium samples for the inner layer was 65 to 70 Rockwell C and a hardness of 75 Rockwell C was obtained on the outer layer.

In a second example, zirconium workpieces comprising spherical valve balls were peened with ceramic beads having a diameter of around 500 microns with an intensity of 10 on an Almen A strip per Military Specification (Mil Spec) 13165C. The fluidized bed of the zirconium oxide particulate material was preheated to a temperature of 1350° F. utilizing air as a fluidizing gas. The fluidized bed was purged for one-half hour using pure argon and the zirconium workpieces were then submerged within the fluidized bed. Then, the gas mixture was changed to add four percent oxygen by mole to the argon gas and the fluidized bed with the zirconium workpieces therein was heated for two hours. The workpieces were then removed from the fluidized bed and air cooled. The outer surfaces of the zirconium workpieces had an uniform gray appearance which appeared to be an improved surface.

In some instance it may be desirable to nitride the workpieces before oxidizing. For that purpose around ½ percent by mole of nitrogen with the argon carrier gas may be introduced within cylinder 50 with an initial surface hardening of the workpieces. Then, oxygen of around 1 percent to 3 percent by mole may be added to the argon carrier gas for obtaining the desired oxidizing and desired hardness. The hardness layers are generally similar to the layers T1 and T2 shown in FIG. 2 but an increased hardness thickness particularly in the outer layer T1 is obtained such as around 12 microns for zirconium and around 2–4 microns for titanium.

It is apparent that the method illustrated in FIG. 3 may be utilized in various steps. For example, it may be desired to cold work and nitride simultaneously either at ambient temperature or at a relatively low heat temperature. The cold working could be accomplished with a reactive gas entrained in the argon carrier gas. While other inert gases, such as neon, may be utilized as a carrier gas, argon has been found to be effective as being entirely inert and relatively free of impurities.

The nitriding process of this invention may provide a relatively thick hardened case on a titanium workpiece, for example, such as a hardened case having a thickness of at least around 50 microns (0.002 inch) and as high as around 250 microns (0.010 inch) in thickness. Titanium and other refractory metal alloys, such a zirconium, tantalum, and hafnium, for example, react very quickly with nitrogen to form a very hard outer case which is very thin, such as around 12 microns (0.0005 inch) in thickness for example. The hardened outer surface formed by the reaction of nitrogen with titanium is a titanium nitride (TIN) surface and by slowing down the formation of the titanium nitride surface to provide additional time for the nitrogen to penetrate more deeply into the titanium metal, a thicker hardened case may be provided of a thickness of at least around 50 microns (0.002 inch) and as high as around 250 microns (0.010 inch) in thickness. A process including a combination of nitrogen and argon gas flowing through a fluidized bed in which a titanium workpiece is immersed, provides a relatively thick hardened case when a relatively small amount of nitrogen such as 1 percent by mole or less is provided in the fluidizing gas passing through the fluidized bed. The metal of the particulate material forming the bed, such as zirconium oxide sand, for example, is inert to the nitrogen gas and has an affinity for oxygen greater than the affinity that titanium has for oxygen so that the titanium is not oxidized. It is important that the gas passed through the fluidized bed contains no oxygen, no hydrogen, and has only a very small amount of nitrogen which may be utilized only for a part of the nitriding cycle.

The process includes the preheating of the fluidized bed to a temperature of around 1500° F. Preheating is obtained by electric coils at a rate of 1,000 kilowatts per cubic foot of the fluidized bed and the preheating time is around one to two hours in order to obtain the preheated temperature of 1500° F. A suitable gas is passed through the fluidized bed during the preheating step and a suitable gas, such as argon which does not contain any nitrogen, oxygen, or hydrogen is utilized. The particulate matter formed in the bed is a zirconium sand of a size generally less than around 125 microns. The zirconium oxide has an affinitive for oxygen greater than the affinity that titanium has for oxygen and this is important for the particulate material forming the bed.

After preheating of the fluidized bed, a small amount of nitrogen, generally less than 1 percent by mole, is added to the gas such as argon for a long term heating of around nine to ten hours of the titanium workpieces. The amount of nitrogen in the gas being passed through the fluidized bed may be increased a small amount during the heat phase but generally the total amount of nitrogen will be less than around 1 percent by mole. The relatively low partial pressure of the nitrogen in combination with the action of bed particles against the surface reduces the rate of formation of the highly impenetrable oxide or nitride surface while the amount of nitrogen is still more than adequate to provide for diffusion into the base metal which is aided by the relatively high temperature. This permits the formation of a relatively thick hardened case such as a case having a total thickness of around 50 microns (0.002 inch) and as high as around 250 microns (0.010 inch) in thickness. Partial pressure is proportional to the mole weight percentage.

After heating of the workpieces, the workpieces are removed from the heated fluidized bed and cooled to a temperature of around 500° F. in a non-oxygen atmosphere. The time period for cooling may be from around one to six hours depending on the size of the workpiece. It is often desirable to cool the items in the bed. In such cases the fluidization is continued with a non-reactive gas during the cooling period.

As a specific example for nitriding a titanium sample, a fluidized bed of ceramic beads having a diameter of around 100 microns was heated to approximately 950° F. utilizing argon as the fluidizing gas. The titanium samples were then submerged in the fluidized bed. The fluidizing gas was then changed to add one-half percent nitrogen to the argon and the titanium samples along with the fluidized bed were heated for a period of eight and one-half hours. The fluidizing bed and the titanium samples were cooled to around 475° F. and the titanium samples were then removed from the fluidizing bed. The outer surfaces of the nitrided titanium samples had a uniform blue color.

Titanium workpieces may be suitably nitrided by placing the titanium workpieces into a cylinder with ceramic beads having a diameter of around 100 microns. Then, the cylinder may be rotated with a pure argon gas flowing through the cylinder at a rate of five cubic feet per hour for heating the cylinder and workpieces to around 1500° F. Then, the gas flow may be changed by adding one-half percent nitrogen to the argon carrier gas and the total gas flow of five cubic feet per hour maintained. The cylinder along with the workpieces and ceramic beads may be heated for around nine hours. After heating the heat source may be removed and the cylinder cooled under ambient conditions while simultaneously changing the gas flow through the cylinder to pure argon gas.

In some instances, it may be desirable to provide hardened nitrided surfaces on refractory metal workpieces without gas fluidizing. Such a nitriding process may be accomplished with the apparatus shown in FIG. 3 by deleting the particulate shot material from the rotating cylinder. The refractory metal workpieces are placed in the cylinder and a predetermined gas mixture of argon and nitrogen is supplied to the rotating cylinder for a predetermined time such as 9 hours, and at a predetermined temperature such as 1500° F. for a grade 2 titanium to provide the hardened outer surfaces for the workpieces.

Also, it may be desirable, particularly for the hardened nitrided surfaces, to clean the workpieces immediately prior to placing the workpieces within the fluidized bed. Such cleaning may be effected by placing the workpieces in a suitable acid or mixture of acids for a limited period of time between around ten seconds and sixty seconds, for example. The acid preferably is nitric acid or hydrochloric acid mixed with around 3 to 5 percent by weight of hydrofluoric acid. Perchloric acid may also provide satisfactory results. It is noted that the workpieces, particularly titanium workpieces, oxidize rapidly if placed in air even after being cleaned in acid. Thus, it is desirable to transfer the cleaned workpieces immediately to the fluidized bed without exposing the workpieces to air or oxygen, if possible. Under certain conditions, the combined workpieces and acid may be placed in the fluidized bed with the acid being vaporized upon subsequent heating. A suitable collector for the vaporized acid would be required in this event.

From the above, it is apparent that the present process for surface hardening of a titanium alloy workpiece while immersed in a fluidized bed of a metallic oxide sand, such as titanium dioxide, provides an optimum environment for uniformly heating the workpiece at a precise temperature for a precise length of time to obtain the desired predetermined hardening of the shell of the titanium workpiece, particularly as a result of periodic weighing of the workpiece so that the desired thickness can be calculated precisely. The titanium workpieces are cleaned in a bath of solvent prior to placing within the heating device so that precise nitriding is obtained on the surface of the workpieces without any foreign or deleterious particles being present.

Because refractory metals will form a thin oxide on the surface in a few minutes at room temperature, it may be desired to remove this oxide after the parts are inserted in the bed. This can be accomplished by mixing into the bed metal particles of material having a greater affinity for oxygen than the refractory alloy of the workpiece. It may also be desirable to place pieces of a refractory metal such as zirconium in the gas supply line or in the fluidized bed plenum. These materials act as a "getter" to react with oxygen existing as a contaminant in an argon or nitrogen stream when performing nitriding operations.

While preferred embodiments of the present invention have been illustrated, it is apparent that modifications or adaptations of the preferred embodiments will occur to those skilled in the art. However, it is to be expressly understood that such modifications and adaptations are within the spirit and scope of the present invention as set forth in the following claims.

What is claimed is:

1. A process for forming a hardened wear resistant outer shell on a zirconium or titanium metal workpiece comprising the following steps:

providing a container for the workpiece;

providing a bed of particulate material in said container;

submerging said workpiece in said bed of particulate material;

effecting relative motion between the outer surface of said workpiece and said particulate material;

providing gas at a predetermined pressure to said container including an inert carrier gas and nitrogen gas for reaction with said workpiece;

controlling the partial pressure of said nitrogen gas of an amount less than around 5 percent by mole to effect a slow rate of chemical reaction between said workpiece and said nitrogen gas; and heating said bed of particulate material to a temperature over around 1100° F. which enhances the diffusion of said nitrogen gas into the surface of said workpiece.

2. The process as set forth in claim 1 further including the step of heating said bed of particulate material for a predetermined time period sufficient to provide an outer relatively thin layer of a generally uniform hardness formed from the material of said workpiece combined with said nitrogen gas and to provide an inner relatively thick layer of a lesser hardness formed from the material of said workpiece combined with said nitrogen gas with the hardness of said inner layer decreasing from its outermost area to its innermost area.

3. The process as set forth in claim 1 including the step of rotating said container about a generally horizontal axis to provide relative movement between said container and said workpiece.

4. The process as set forth in claim 1 including the step of stressing the outer surface of said workpiece to decrease the grain size thereof and to provide a generally uniform surface texture thereby to assist the diffusion of said nitrogen gas into said workpiece.

5. The process as set forth in claim 4 wherein the step of stressing the outer surface of said workpiece comprises the step of frictionally contacting the outer surface of said workpiece with particulate material.

6. The process as set forth in claim 4 further including the step of polishing the outer surface of said workpiece prior to heating thereof.

7. The process as set forth in claim 2 wherein the step of providing nitrogen gas forms said outer layer of a metal nitride of which said workpiece is formed and forms said inner layer of an alloy of the metal from which said workpiece is formed and nitrogen.

8. The process as set forth in claim 2 further including the step of providing nitrogen gas for a predetermined period of time, and then changing said nitrogen gas to oxygen gas.

9. A process for forming a hardened wear resistant outer shell on a titanium workpiece comprising the following steps:

providing a container for the titanium workpiece;

providing a bed of particulate material in said container;

submerging said titanium workpiece in said bed of particulate material;

effecting relative motion between the outer surface of said titanium workpiece and said particulate material;

providing gas at a predetermined pressure to said container including an inert gas and an active nitrogen gas for reaction with said titanium workpiece;

controlling the partial pressure of said nitrogen gas of an amount less than around 3 percent by mole to effect a slow rate of chemical reaction between said titanium workpiece and said hydrogen gas; and heating said bed of particulate material to a predetermined temperature for a predetermined period of time to enhance the diffusion of nitrogen gas into the surface of said titanium workpiece to a predetermined depth.

10. A process as set forth in claim 9 including the step of removing the titanium workpiece from said fluidized bed for weighing for determining the precise period of time for applying heat to obtain the desired thickness of said hardened outer shell.

11. A process as set forth in claim 9 including the step of providing a metallic oxide particulate material for said fluidized bed.

12. A process as set forth in claim 9 including the step of providing a metallic particulate material for said bed.

13. A process for forming a hardened wear resistant outer shell on a zirconium or titanium workpiece comprising the following steps:

providing a container for the workpiece;

providing a bed of particulate material in said container;

submerging said workpiece in said bed of particulate material;

providing gas at a predetermined pressure to said container including an inert carrier gas and a predetermined active gas comprising nitrogen for reaction with said workpiece;

controlling the partial pressure of said nitrogen gas of an amount less than around 5 percent by mole to effect a slow rate for chemical reaction between said workpiece and said active gas;

heating said bed of particulate material to a predetermined temperature for a predetermined period of time to enhance the diffusion of said nitrogen gas into the surface of said workpiece to a predetermined depth; and effecting relative motion between the outer surface of said workpiece and said particulate material for frictionally contacting the outer surface of said workpiece with particulate material.

14. The process as set forth in claim 13 wherein the step of effecting relative motion between the workpiece and particulate material is provided by rotating said container with the particulate material and workpiece therein.

15. The process as set forth in claim 13 wherein the step of effecting relative motion between the workpiece and particulate material is provided by fluidizing the bed of particulate material with said gas.

16. A process of forming a hardened outer shell on a titanium alloy workpiece comprising the following steps:

providing a bed of pulverulent metal oxide material having an affinity for oxygen at least as great as titanium;

fluidizing said bed by providing a flow of an inert gas stream through said pulverulent material for a predetermined fluidizing period; said gas stream containing oxygen for at least a portion of the fluidizing period of an amount less than around 5 percent by mole;

placing the titanium alloy workpiece within said fluidizing bed; and heating said fluidized bed to a predetermined temperature over at least around 1200° F. for a predetermined time period to form a hard titanium oxide surface layer on the outer exposed surface of said workpiece.

17. A process for forming a hardened wear resistant outer shell on a titanium alloy workpiece comprising the following steps:

providing a container for the titanium alloy workpiece;

providing a bed of particulate material in said container, submerging said titanium alloy workpiece in said bed of particulate material;

effecting relative motion between the outer surface of said titanium alloy workpiece and said particulate material;

providing gas at a predetermined pressure to said container including inert gas and oxygen gas for reaction with said titanium alloy workpiece;

controlling the partial pressure of said oxygen gas of an amount less than around 5 percent by mole to effect a slow rate of chemical reaction between said titanium alloy workpiece and said oxygen gas; and heating said bed of particulate material to a temperature over 1100° F. for a predetermined period of time to enhance the diffusion of oxygen into the surface of said titanium alloy workpiece.

* * * * *